United States Patent [19]

Tanabe et al.

[11] Patent Number: 5,047,082

[45] Date of Patent: Sep. 10, 1991

[54] METHOD FOR SMELTING REDUCTION OF NI ORE

[75] Inventors: Haruyoshi Tanabe; Katsuhiro Iwasaki; Masahiro Kawakami; Chihiro Taki; Toshio Takaoka, all of Tokyo, Japan

[73] Assignee: NKK Corporation, Tokyo, Japan

[21] Appl. No.: 460,238

[22] Filed: Jan. 2, 1990

[30] Foreign Application Priority Data

Mar. 9, 1989 [JP] Japan ..... 1-057179

[51] Int. Cl.[5] ..... C22B 23/00

[52] U.S. Cl. ..... 75/629; 420/119

[58] Field of Search ..... 75/629; 420/94, 119

[56] References Cited

U.S. PATENT DOCUMENTS 4,504,311 3/1985 Weiner ..... 75/382

FOREIGN PATENT DOCUMENTS 58215 4/1983 Japan ..... 420/119

*Primary Examiner*—Melvin J. Andrews

*Attorney, Agent, or Firm*—Frishauf, Holtz, Goodman & Woodward

[57] ABSTRACT

A method for smelting reduction of Ni ore comprises charging Ni ore and carbonaceous material into a converter type smelting reduction furnace having bottom-blow tuyeres and a top-blow lance, the smelting reduction furnace holding a molten metal, blowing oxygen gas from the top-blow lance and a stirring gas from the bottom-blow tuyeres into the furnace, and discharging slag so that a relation represented with a formula $$Vo > 0.4\ Ws + 1.0$$

can be satisfied, Vo ($m^3$ per ton of molten metal) being a specific volume of the smelting reduction furnace per ton of molten metal and Ws (ton per ton of molten metal) being 2 specific weight of slag per ton of molten metal.

11 Claims, 1 Drawing Sheet

METHOD FOR SMELTING REDUCTION OF NI ORE

BACKGROUND OF THE INVENTION

1. Field of the Invention

The present invention relates to a smelting reduction of Ni ore, and more particularly to a method for smelting reduction of Ni ore wherein a converter type smelting reduction furnace is used and a slopping due to slag produced in large quantities is prevented from taking place.

2. Description of the Prior Arts

Stainless steel has previously been manufactured by melting scrap and ferrochrome and ferronickel being ferro alloy or electrolytic nickel in an electric furnace. That is, Cr and Ni being the main components of stainless steel has been obtained by melting ferro alloy having previously been reduced in an electric furnace. Against such prior art method, recently, attention is paid in terms of energy saving and a decrease of a manufacturing cost to a smelting reduction method wherein molten metal with high chromium content is obtained directly from Cr ore as a chromium source.

As far as Cr was concerned, it is tried to manufacture stainless steel by directly reducing Cr ore in a converter type smelting reduction furnace as described above. However, it has not been tried to manufacture stainless steel by directly reducing Ni ore. The reason for this is that, since only about 2 to 3% Ni is contained in Ni ore, a great amount of Ni ore has to be used for manufacturing stainless steel by directly reducing Ni ore; operations of the converter type furnace are thus regarded as difficult. In the case of manufacturing stainless steel of 8% Ni, for example, 3 to 4 tons of Ni ore per ton of stainless steel are used. Accordingly, during a smelting reduction of Ni ore, there is a possibility of a break of operations, damage of equipment or a decrease of the yield of Ni due to occurrence of the slopping in connection with production of a great amount of slag. On the other hand, when the slag is many times discharged from a furnace to avoid the occurrence of the slopping, there is a possibility such that the yield of Ni decreases extremely as a result of an escape of molten metal during discharge of the slag and an efficiency in work decreases.

SUMMARY OF THE INVENTION

The present invention is made in view of the above-described situation and it is an object of the present invention to provide a method for a smelting reduction of Ni ore wherein stability of operations is secured and the yield of Ni is not lowered by occurrence of a great amount of slag.

To accomplish the above-mentioned object, a method for smelting reduction of Ni ore is provided, comprising:

charging Ni ore and carbonaceous material into a converter type smelting reduction furnace having bottom-blow tuyeres and a top-blow lance, said smelting reduction furnace holding a molten metal;

blowing oxygen gas from said top-blow lance and a stirring gas from said bottom-blow tuyeres into said furnace; and discharging slag so that a relation represented with a formula $$Vo > 0.4Ws + 1.0$$

can be satisfied, Vo ($m^3$ per ton of molten metal) being a specific volume of said smelting reduction furnace per ton of molten metal and Ws (ton per ton of molten metal) being a specific weight of slag per ton of molten metal.

The above objects and other objects and advantages of the present invention will become apparent from the detailed description which follows, taken in conjunction with the appended drawings.

DESCRIPTION OF THE PREFERRED EMBODIMENT

Figure 1:
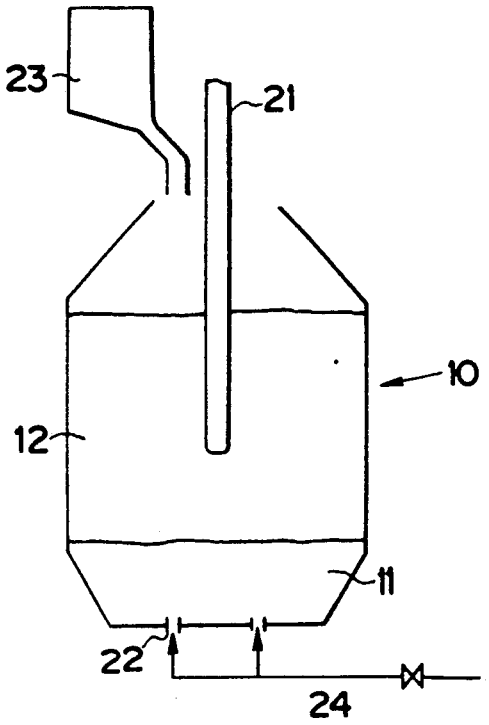
FIG. 1 is a vertical section view illustrating a smelting reduction furnace of an example of the present invention.

An example of the present invention will be described with specific reference to the appended drawings. FIG. 1 depicts the smelting reduction furnace 10 of the example. In the drawing, reference numeral 21 denotes a top-blow lance, 22 a bottom-blow tuyere, 11 molten metal, 12 a slag layer, 23 a hopper for charging Ni ore, carbonaceous material or flux as material into the smelting reduction furnace 10 and 24 feed pipe for feeding stirring gas to the bottom-blow tuyere 22.

A method for manufacturing molten metal containing a predetermined amount of Ni by the use of the smelting reduction furnace constituted as described above will be described. Initially, molten metal of iron is charged into the smelting reduction furance. Subsequently, carbonaceous material is charged into the smelting reduction furnace. Then, after oxygen has been blown into the smelting reduction furnace and a temperature of the molten metal has been raised upto about 1500° C., Ni ore begins to be charged into the smelting reduction furance 10. In the case of repeatedly carrying out operations, the molten metal is made up for by the molten metal containing Ni which has previously been charged.

The stirring gas begins to be blown from the bottom-blow tuyeres 22 into the smelting reduction furnace 10 from the moment when the molten metal has been charged into the smelting reduction furnace 10 with a flow of the stirring gas so that the tuyeres 22 cannot be blocked. Blow of said stirring gas is increased if necessary. Charged Ni ore is reduced by C in the molten metal. Heat energy for smelting Ni ore is supplied by combustion of the carbonaceous material in its reaction with oxygen, that is, by the reactions $C \rightarrow CO$, $CO \rightarrow CO_2$.

A content of oxides of Fe and Ni contained in Ni ore generally used is about 30%. The other 70% consists of $SiO_2$, MgO, crystallization water and other slag components. A content of Ni in Ni ore is about 2 to 3%. Slag produced by both of Ni ore and carbonaceous material forms slag during a smelting reduction of Ni ore. The weight of slag accounts for about 80% of the weight of the Ni ore. Accordingly, when molten metal containing 8 wt. % Ni is manufactured, 2 to 3 tons of slag per ton of the molten metal are produced although the amount of produced slag per ton of the molten metal varies dependent on the content of Ni in Ni ore and a predetermined content of Ni in molten iron. Since a bulk density of slag during the smelting reduction is about 1.5, the volume of slag can be about 15 times larger than that of the molten metal. In consequence, a break of operations and damage of equipment can be produced by a slopping of the slag and this prevents the operations from being stably carried out and decreases the yield of Ni. Moreover, it can greatly decrease the yield of Ni due to an outflow of the molten metal during discharge of slag to increase the number of discharges of the slag during the smelting reduction of Ni ore in order to prevent the slopping from being produced due to the great amount of slag.

Figure 2:
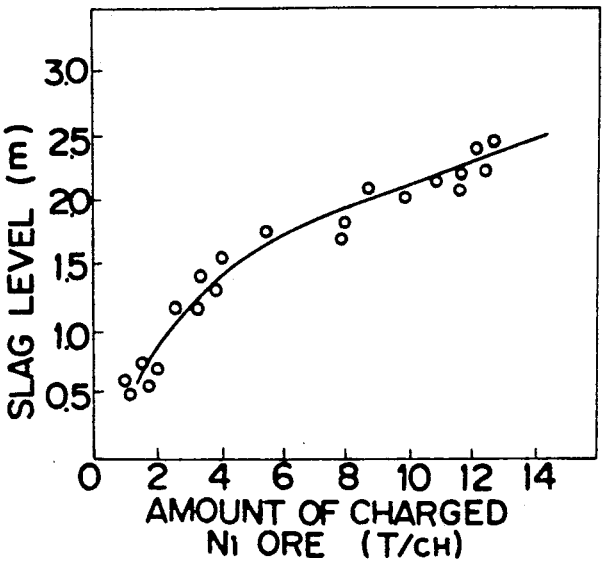
FIG. 2 is a graphical representation indicating the relation between an amount of Ni ore charged into the smelting reduction furnace and a level of slag in the smelting reduction furnace.
Figure 3:
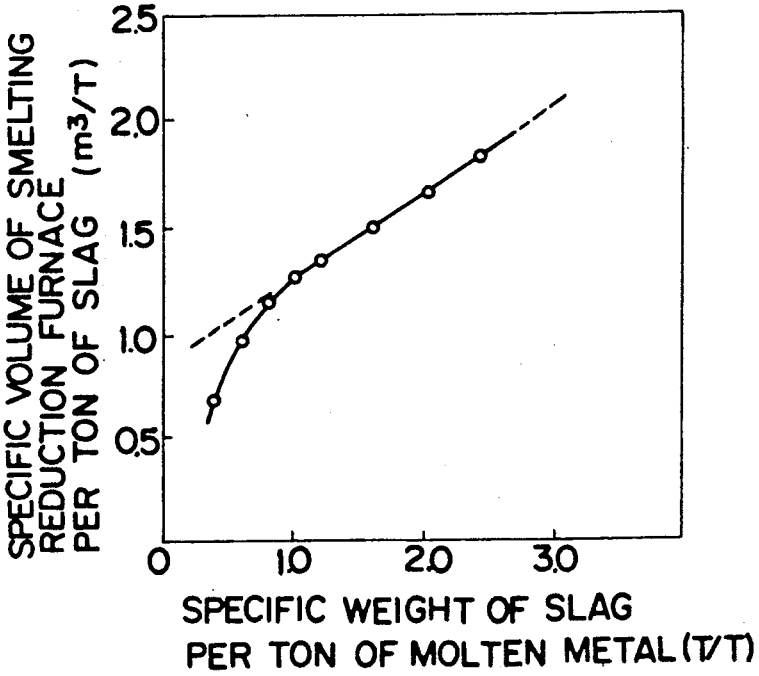
FIG. 3 is a graphical representation designating the relation between specific weight and specific volume of slag in the smelting reduction furnace.

A problem of a volume of the smelting reduction furnace and a time of discharge of slag is posed to secure the stability of operations and to increase the yield of Ni. Accordingly, tests were conducted to find the relation between an amount of Ni ore charged into the smelting reduction furnace and a level of slag therein for the purpose of finding an appropriate time of the discharge of slag, the amount of Ni ore to be charged into the smelting reduction furnace and the volume of the smelting reduction furnace. A result of the tests is shown in FIG. 2. In FIG. 2, the graph is of a straight line when the amount of charged Ni ore is 4 t or more. It is thought that this is because a volume of gas contained in slag is large when the volume of slag is small. FIG. 3 is a graphical representation indicating the relation between a specific weight Ws and a specific volume Vs of the slag which was obtained by analyzing the data in FIG. 2. Ws is a specific weight of slag per ton of molten metal and Vs is a specific volume of smelting reduction furnace per ton of slag. Hereinafter, the units of V and W are the same as those mentioned above. From the graph in FIG. 3, the relation between the specific weight Ws and specific volume Vs of slag can be represented with the formula $Vs=0.4\ Ws+0.85$ in a portion of a straight line where Ws is 1 or more. By adding the specific volume of molten metal of 0.15 to this formula, a specific volume Vsm of the slag and the molten metal held in the smelting reduction furnace is represented with the following formula:

$$Vsm=0.4Ws+1.0 \quad (1).$$

A constant of the formula (1) is determiend so that the units of both sides of the formula can be the same. An actual operation satisfies $Ws>1$. The volume of the smelting reduction furnace and the time for the discharge of slag will be studied below relative to said formula (1).

When the specific volume of the smelting reduction furance 10 is Vo, the following condition is indispensable to prevent the smelting reduction furnace from being unstably operated due to the slopping of the slag:

$$Vsm<Vo \quad (2).$$

This condition can be represented as follows by putting the formula (1) into the formula (2):

$$Vo>0.4Ws+1.0 \quad (3).$$

Further, the formula (2) can be converted to the following formula:

$$Vsm=\alpha Vo \quad (4).$$

In the formula (4), $\alpha$ is $0<\alpha<1$. When $\alpha$ is near 1, the operation can be unstable due to the slopping of slag and, conversely, when $\alpha$ is near 0, the volume of the smelting reduction furnace becomes too large although the slopping does not affect the operation. This is not economical and makes it difficult to carry out an effective operation. In terms of the above-described, $\alpha$ is desired to be within the followng range:

$$0.8<\alpha<0.95 \quad (5).$$

This condition can be converted to the following formula by putting the formulas (1) and (4) into the formula (5):

$$0.8Vo<0.4Ws+1.0<0.95Vo \quad (6).$$

From the formulas (3) or (6), the time for discharge of slag is determined with regard to the specific gavity Ws of the slag so that the slopping of the slag cannot occur. Further, when an allowable specific gravity Ws of produced slag is determined on the basis of a predetermined amount of molten metal of Ni and Ni component contained in the molten metal so that any slopping cannot be produced before the discharge of slag, the specific volume Vo of the smelting reduction furnace can be found. Since the relation between an amount Wn of Ni ore charged into the furnace and said Ws is easily known by the amount of material charged into the furnace and Ni component contained in Ni ore, the time for discharge of slag can be determined to avoid unstable operations of the furnace and the decrease of the yield of Ni in connection with the occurrence of the slopping.

According to the present invention, since the relation between the amount of slag and the amount of Ni ore charged into the smelting reduction furnace is found, a time for discharge of slag or molten metal can be determined so that any slopping cannot occur and, moreover, when an amount of molten metal to be manufactured and a content of Ni are determined, a favorable volume of the smelting reduction furnace can be found.

EXAMPLE

A specific example in case Ni ore is smelted in a smelting reduction furnace of 5 tons capacity with a content volume of 10 $m^3$ will be described. An amount of produced slag accounts for 80% of the amount of Ni ore charged into the furnace as described above. When the amount of Ni ore charged into the furnace before the discharge of slag is 13 t/ch and molten metal is 10 t/ch, $Vsm=0.4\times2.0+1.0=1.80$ is obtained by putting $Ws=10/5=2.0$ into the formula (1). In connection with $\alpha=Vsm/Vo=1.8/2=0.90$, the following formula is obtained:

$$0.8<\alpha=0.90<0.95$$

In this way, the above-mentined formula (5) is satisfied. Accordingly, in this case, if slag is dishcarged when the amount of Ni ore charged into the furance reaches 13 t, the slopping of slag can be avoided.

What is claimed is:

1. A method for a smelting reduction of Ni ore, comprising:

providing a molten metal comprising iron in a converter smelting reduction furnace;

charging a Ni ore and a carbonaceous material into said converter smelting reduction furnace, said furnace having at least one bottom-blow tuyere and a top-blow, lance;

blowing oxygen gas from said top-blow lance and blowing a stirring gas from said bottom-blow tuyere into said furnace thereby reducing the Ni ore and forming Ni in said molten metal and forming slag; and discharging slag so that a relation represented by a formula $$Vo > 0.4Ws + 1.0$$

is satisfied, wherein Vo is a specific volume of said smelting reduction furnace in $m^3$ per ton of said molten metal containing Ni and Ws is a specific weight of tons of slag per ton of molten metal.

2. The method of claim 1, wherein said step of discharging slag comprises discharging slag so that a relation represented by a formula $$0.8Vo < 0.4Ws + 1.0 < 0.95Vo$$

is satisfied, wherein Vo is a specific volume of said smelting reduction furnace in $m^3$ per ton of molten metal and Ws is a specific weight of tons slag per ton of molten metal.

3. The method of claim 1, wherein the Ni ore comprises oxides of Fe and Ni of 30%, with the remaining 70% comprising $SiO_2$, MgO, crystallization water and other slag components.

4. The method of claim 3, wherein the Ni ore comprises a Ni content of 2 to 3%.

5. The method of claim 1, wherein the weight of the slag corresponds to about 80% of the weight of the Ni ore.

6. The method of claim 1, wherein said molten metal containing 8 wt. % Ni and 2 to 3 tons of slag per ton of the molten metal are produced.

7. The method of claim 1, wherein the slag has a bulk density of 1.5.

8. The method of claim 1, wherein said Ni ore is charged after a temperature of 1500° C. is reached in said furnace.

9. The method of claim 1, wherein the slag has a bulk density of 1.5.

10. The method of claim 1, wherein said Ni ore is charged after a temperature of 1500° C. is reached in said furnace.

11. The method of claim 9, wherein said Ni ore is charged after a temperature of 1500° C. is reached in said furnace.

* * * * *